United States Patent [19]

Francois

[11] Patent Number: 5,071,713

[45] Date of Patent: Dec. 10, 1991

[54] METAL FIBERS OBTAINED BY BUNDLED DRAWING

[75] Inventor: Roger Francois, St.-Eloois-Vijve, Belgium

[73] Assignee: N. V. Bekaert S.A., Zwevegem, Belgium

[21] Appl. No.: 491,060

[22] Filed: Mar. 9, 1990

Related U.S. Application Data

[62] Division of Ser. No. 316,917, Feb. 28, 1989, Pat. No. 4,925,539.

[30] Foreign Application Priority Data

Mar. 17, 1988 [BE] Belgium ..... 8800306

[51] Int. Cl.[5] ..... C25F 5/00

[52] U.S. Cl. ..... 428/606; 428/607; 428/610

[58] Field of Search ..... 428/606, 607, 610, 605; 204/146

[56] References Cited

U.S. PATENT DOCUMENTS

| | | | |
|---|---|---|---|
| 2,050,298 | 8/1936 | Everett | 428/606 |
| 2,215,477 | 9/1940 | Pipkin | 426/606 |
| 3,379,000 | 4/1968 | Webber et al. | 57/243 |
| 3,504,516 | 4/1970 | Sundberg | 428/606 |
| 3,505,039 | 4/1970 | Roberts et al. | 428/606 |
| 3,567,407 | 3/1971 | Yoblin | 428/593 |
| 3,698,863 | 10/1972 | Roberts et al. | 428/606 |
| 3,912,603 | 10/1975 | Mietens et al. | 204/146 L |
| 4,139,376 | 2/1979 | Erickson et al. | 75/229 |
| 4,161,434 | 7/1979 | Quinlan et al. | 204/146 |

FOREIGN PATENT DOCUMENTS 1502924 3/1978 United Kingdom .

*Primary Examiner*—John J. Zimmerman
*Attorney, Agent, or Firm*—Nixon & Vanderhye

[57] ABSTRACT

Metal fibers obtained by the bundled drawing of a composite bundle of metal wires embedded in a metal matrix followed by the electrolytic removal of the matrix so that the surface layers of the fibers contain only a negligible amount (≦0.2% at) of the matrix metal. Furthermore, a description is given of a process and an apparatus for the continuous electrolytic removal of the matrix material. Thereby, the composite bundle acts as an anode. Stainless steel fibers according to the invention have an average Cr/Cr+Fe+Ni content at their surface between 1% and 15%.

12 Claims, 3 Drawing Sheets

METAL FIBERS OBTAINED BY BUNDLED DRAWING

This is a division of application Ser. No. 07/316,917, filed Feb. 28, 1989, now U.S. Pat. No. 4,925,539.

FIELD OF THE INVENTION

The present invention relates to metal fibers obtained by the bundled drawing of wires embedded in a matrix which consists of a different metal than the fibers. After the drawing operation, the matrix material is removed, leaving a bare bundle of fibers. Specifically, the invention also comprises a process and an apparatus for the continuous electrolytic removal of said metal matrix, using the embedded bundle as an anode.

BACKGROUND AND SUMMARY OF THE INVENTION

U.S. Pat. No. 3,379,000 describes the manufacture of stainless steel fibers by bundled drawing, i.e. starting with a bundle of wires embedded in a metal matrix which differs from the wire metal, e.g. in copper sheaths. After the drawing, the copper is stripped in a nitric acid solution. The fibers which are obtained using this patented method still show some traces or remnants of the matrix material (copper) at their surfaces.

To turn the stripping of the matrix metal in $HNO_3$ into an ecologically sound process, considerable sums must be spent on the neutralizing of the generated nitrogen oxide fumes and on converting the used stripping fluid into disposable waste. Apart from that, some remnants of the metal matrix are left on the fiber surface. Thus, this surface is somewhat contaminated and this can be a disadvantage in certain applications.

With the present invention it is now possible to manufacture metal fibers, using the bundled drawing method as described above and yet avoid this contamination of the fiber surface.

The average concentration of matrix metal in the surface layers of the fibers thus obtained is at the most 0.2% at. The average copper content in the surface layers of standard metal fibers, obtained by applying the $HNO_3$ stripping process to a copper matrix, is more than 2% at. The thickness of the surface layer under consideration is about 50 Å.

The metal fibers obtained by applying the present invention may be stainless steel fibers with a chromium content of at least 10% by weight. Specifically, the fibers will contain at least 16% Cr and also Ni. Furthermore, the invention can be used to manufacture refractory fibers containing Fe, Cr, Al and, optionally, Y or rare earths (as is described, for example, in U.S. Pat. No. 4,139,376) and fibers from Ni/Cr alloys, Hastelloy ®, Inconel ®, titanium or Carpenter ®20cb3.

It is also an object of the invention to provide stainless steel fibers of the kind specified above and having a reduced average Chromium content (a lower Cr/Cr+Fe+Ni-ratio) at their surface, i.e. with a Cr/Cr+Fe+Ni-ratio between 1% and 15% wherein the Cr, Ni and Fe-contents are expressed in at %. Even if said fibers retain more than 0.2% at of matrix metal at their surface, the lower Cr-content offers the advantage of a better corrosion resistance as will be explained further on.

The invention also comprehends a process and apparatus for the continuous electrolytic removal of the matrix material from a drawn composite bundle.

Thereby, the bundle serves as an anode and the embedded bundle is transported continuously through successive electrolytic baths at a temperature of over 20° C.

It is a further object of the invention to provide a discontinuous or batch process for electrolytic removal of the matrix material from a drawn composite fiber bundle. This process is particularly useful when thin bundles have to be treated which can hardly sustain throughput forces in a long continuous stripping installation.

Contrary to the process in conventional continuous electrolytic stripping installations, the bundle does not make contact with current carrying (anodically connected) contact elements. Cathodic transition cells are present between said baths. During the process, the bundle is supported at the level or in the vicinity of these transistion cells. The arrangement and the distances between the various cells or baths are such that in the spaces between the electrolytic baths and the cathodic transistion cells the current is conducted by the bundle. During the process, at least part of the matrix material is deposited on the cathodes facing the bundle in the electrolytic baths. All these measures contribute to the development of a more econmical process with the additional advantage of a higher quality fiber product. The fibers are less damaged as will be shown further and some of their characteristics are more constant, i.e. display less variation than in case of standard bundled drawn fibers.

These points will now be explained in more detail on the basis of an embodiment of the invention, illustrating the unexpected additional advantages.

BRIEF DESCRIPTION OF THE DRAWINGS

For comparison.

DETAILED DESCRIPTION OF THE PREFERRED EMBODIMENT

Figure 1:
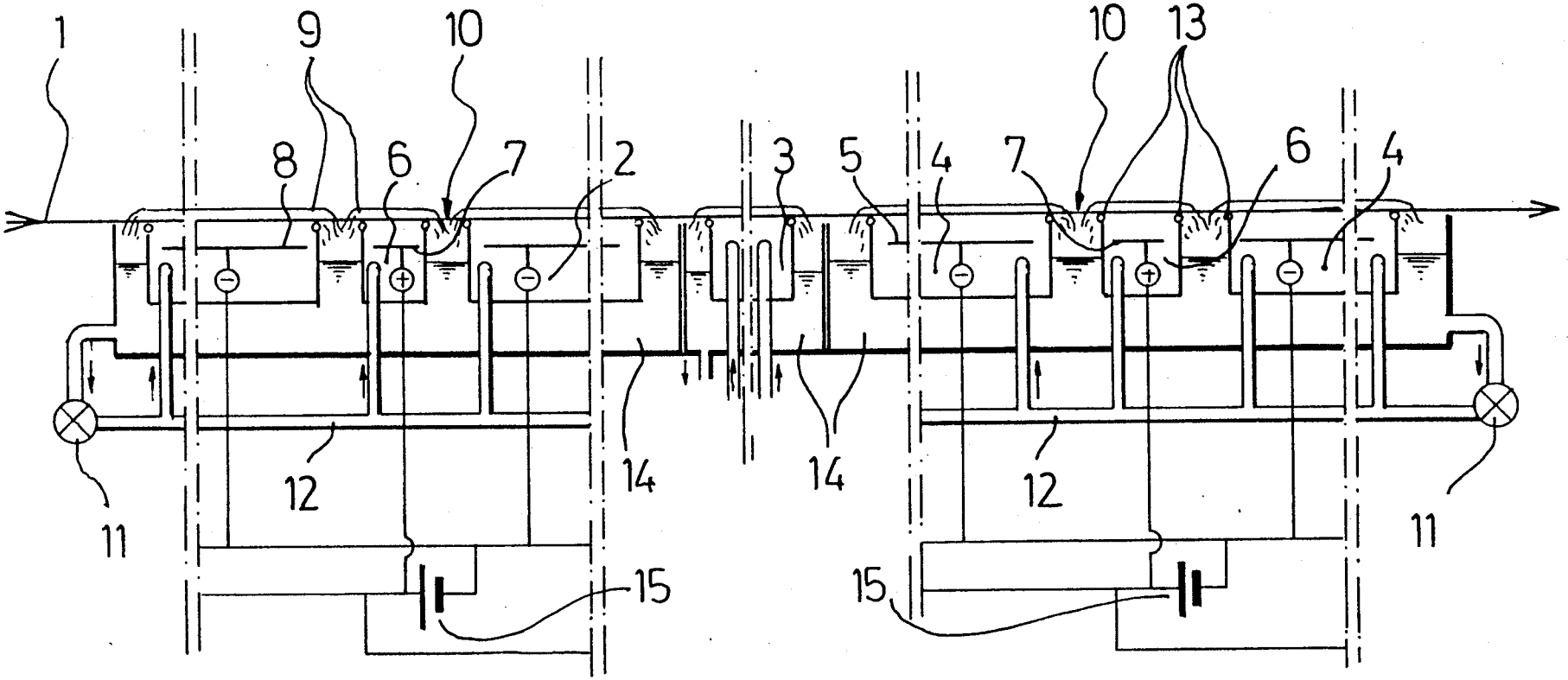
FIG. 1 is a diagram of a processing installation for the continuous removal of the matrix material from the bundle.

A series of composite bundles 1, obtained by the usual process of bundled drawing, consisting of several thousands of metal fibers embedded in a body of copper and surrounded by an iron jacket, are transported continuously through an apparatus in accordance with the present invention and specifically through a series of electrolytic baths 2 and 4 for the removal of the metal matrix, i.e. the iron jacket and the body of copper. As schematically represented in FIG. 1, the iron jacket of bundle 1 is removed by dissolution in a first series of electrolytic baths 2. Subsequently, the bundles 1 pass through a rinsing apparatus 3 and the copper matrix is removed in a next series of electrolytic baths 4. During the process, the copper is recuperated at least in part and preferably in full by deposition on the cathodes 5. This prompt recuperation of metal is an important advantage compared to the earlier treatment with $HNO_3$.

In accordance with the invention, cathodic transition cells 6 are placed between the successive baths 2 resp. 4, in which anodes 7 have been mounted—e.g. made of lead—facing the passing bundles 1. On the other hand, in baths 2 resp. 4, the cathode plates 8, resp. 5 have been placed at a distance of several centimeters from the path of the bundle. As a result, current carrying contact elements may be omitted. This was found to be an advantage because, among other things, the current transmission to the bundles by way of mechanical contact (e.g. via rolls) can become increasingly irregular as more matrix material disappears from the bundle.

In general, current transmission by mechanical contact elements causes an additional tensile strain on the bundle as well. As the total processing apparatus can reach a considerable length (especially when aiming for a high and therefore productive processing speed) the bare bundle (as a result of the installation of contact rolls) would have to overcome yet an additional tensile strain at the exit. This would increase the chance of fiber or bundle fracture. The broken off pieces of the fibers might then wind themselves around the contact rolls which could impede the regular transmission of current even more and which could damage the bundle.

In order to minimize current leakage at the transitions between bath and cells, and hence to minimize energy consumption, the overflow sections 9 of successive baths and cells are placed at a sufficient distance from each other so that at least a major part of the electrical current is forced to flow through the bundle in these transition zones 10. Apart from that, this measure promotes the controllability of the electrolytic process.

Preferably, the temperature of the electrolytes in the various baths and cells should be higher than room temperature (over 20° C.); e.g. 50°-60° C., in order to increase the efficiency of the matrix removal. In principle, quite some compositions are possible for the electrolytic bath, acidic as well as alkaline. For example, a bath containing sulfuric acid can be used in the section for removing iron (2) as well as in the section for removing copper (4). Obviously, if the metal matrix contains only copper, a copper removal section (40) will suffice. In this case, a suitable electrolyte might contain $H_2SO_4$ and $CuSO_4$. In the baths 2, lead cathodes 8 can be used. However, in the baths 4 it is preferable to use cathodes 5 made of a stronger material (metal) and with less adhesive affinity with respect to the matrix material which has to be deposited. This facilitates the mechanical removal of the layer of metal deposit from these cathodes 5. Naturally, the installation is equipped with pumps 11 and pipes 12 for the circulation of the fluids from the various collectors 14 to the baths 2, 3, 4 and cells 6 and to the respective overflow sections 9. At regular distances in the installation, the bundles are supported by e.g. ceramic cross-bars or combs 13. Preferably, these wear resistant means of support 13 should be mounted at or near the place of the transition zones 10.

It is advisable to use current stabilized rectifiers 15 for the current supply. Current densities between 5 and 75 Å per $dm^2$ of bundle surface were found to be suitable for the iron removal baths. Preferably, the sulfuric acid concentration should be between 200 and 400 g/l. In order to realize an iron removal efficiency of more than 100% in the baths 2, passivation of the iron jacket must be prevented. This can be achieved by using a relatively low current density (e.g. less than 30 Å/$dm^2$) in the first bath(s). It was also found that this high efficiency can be obtained by limiting the increase of the molar product of the iron ions with the sulfuric acid concentration in the electrolyte. A suitable value for the molar product is, for example, 2.5. The efficiency can become higher than 100% because, apart from the electrolytic dissolution process of the iron jacket, a simultaneous chemical iron dissolution process occurs as well.

In order to keep the local current density variations within acceptable limits in the electrolytic baths 2 or 4, it turned out to be advisable to select a bath length in the transport direction of the bundle of less than 75 cm. A practically uniform current density distribution in the baths has the advantage of permitting a higher total current without negative effect on the efficiency. Naturally, the cathodic transition cells can be much shorter.

Furthermore, it was found advantageous from the viewpoint of the lowest possible energy consumption and the realization of a uniform current density distribution, to install successive power supply circuits for successive series of baths and to separate these from each other. This separation could be effected, for example, at the level of the cathodic transition cells 6 which are situated between one series of baths and the next. A series of baths may consist of one or more baths. In order to dissolve as little copper as possible in the last electrolytic bath 2, the current here (Å/$dm^2$) will have to remain relatively low. The copper removal baths may have the same composition as the usual copper sulfate/sulfuric acid baths for the electrolytic deposition of copper. Furthermore, the average current densities, normally used in this kind of electrolysis (direct current or pulsating current) were found to be suitable for the invention.

In the discontinuous process for electrolytic removal of the matrix metal from the composite bundle, again the composite acts as an anode. Therefor, the bundle is stored on a metallic supporting frame which is anodically polarized. A convenient frame is e.g. a spool of steel wire equal or similar to that disclosed in U.K. patent No. 1,502,924 onto the core of which the composite bundle is wound in a substantially cylindrical layer. The layer thickness is preferably small in view of permitting a sufficient penetration for the electrolyte which has to dissolve the matrix material during the electrolysis process. The frame with the bundle stored on it is submerged in a bath containing as electrolyte a solution of $H_2SO_4$ above room temperature. In view of accelerating the dissolution process the electrolyte is either continuously stirred or circulated by means of a pump so as to force on a continuous basis a fresh solution interbetween the neighbouring windings in the cylindrial layer.

Metal plates are suitably arranged in the bath as cathodes thereby facing the outside and/or inside of the cylindrical layer. The plate design and their disposition is of course choosen to avoid a substantial obstruction of the fluid flow through the bath.

The electrical current to the electrodes is supplied by a voltage stabilized rectifier. The voltage is set at a value below 2.5 V. A suitable maximum current is e.g. 20 Å per kg of composite to be treated. In this way, the matrix material is completely removed after a run of several hours with an electrolyte at a temperature of almost 50° C.

EXAMPLE

A composite bundle of stainless steel fibers with a fiber diameter of 12μ of the type AISI-316L, embedded in copper and surrounded by an iron jacket, was treated in the apparatus and according to the continuous process described above. The various values of the current densities, bath lengths, bath concentrations, temperatures etc. were kept within the above mentioned limits.

The resulting fiber bundle, and in particular the composition of its surface layer, was compared to the same bundle 316L which had been stripped in $HNO_3$ in the standard manner.

The average tensile strength of the fiber obtained by applying the invention was 8.85% higher than that of the standard stripped fibers, while the variation in the value of the tensile strength over its length was considerably smaller. This is presumably due to the fact that the nitric acid affects the very thin fibers in a more aggressive, irregular and penetrating way than a well regulated electrolytic process.

The results of an analysis of the composition of the surface layer of both types of fibers (Scanning Auger Multiprobe) have been summarized in table 1. The percentages are averages.

TABLE 1

| surface layer (0.75 μm) | N % at | Cr/Ni % | Cr/Cr + Fe + Ni % | Cu at % |
|---|---|---|---|---|
| fiber obtained with invention | 1 | 70 | 7 | 0 |
| fiber obtained by standard technique | 3 | 220 | 22 | 2.3 |

Figure 2:
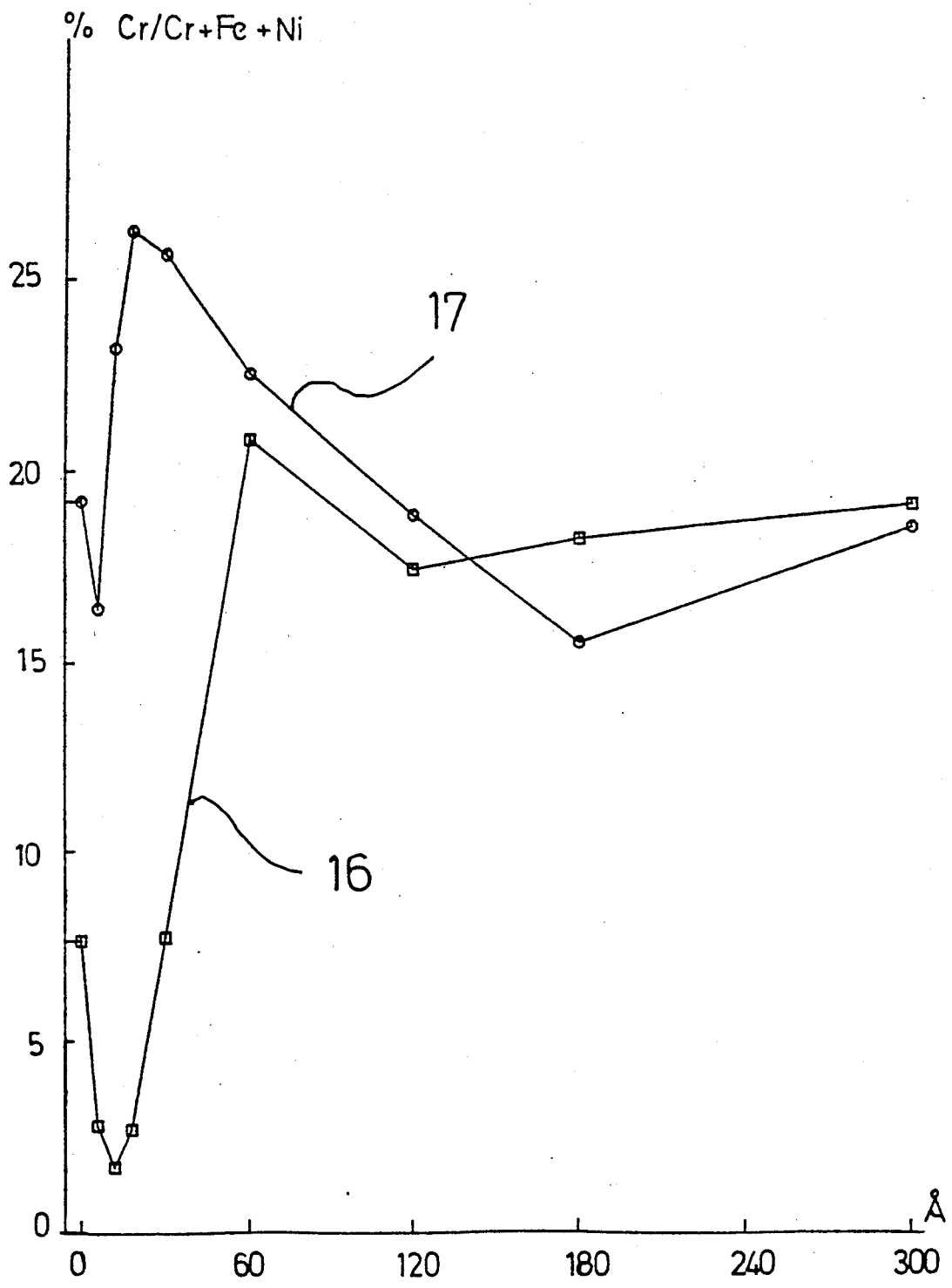
FIG. 2 shows the composition profiles for quantities of Cr and Ni close to the surface of a stainless steel fiber for a bundle obtained by a standard method and for a bundle obtained by applying the present invention.

FIG. 2 shows the variation of the Cr/Cr+Fe+Ni-content throughout the fiber thickness for both types of fibers. Curve 17 applies to the fiber bundle which was stripped in $HNO_3$ while curve 16 applies to the fiber bundle which was treated in accordance with the invention. When $HNO_3$ is used, the Ni at the fiber surface will be depleted faster than the Cr, while the application of $H_2SO_4$ has the opposite effect. Therefore, the ratios as shown in FIG. 2 and table 1 confirm the expected composition changes for both removal processes. It was even established that to strip composite bundles with copper matrixes and fibers from Fe/Cr alloys (possibly with a very low Ni-content) such as AISI-430 types, in $HNO_3$ is quite difficult. A possible explanation could be the (almost complete) lack of Ni at the fiber surface. However, with the electrolytic stripping process in $H_2SO_4/CuSO_4$-baths in accordance with the invention, the copper between these fibers can be removed much faster, probably because of the presence, and thus the depletion possibility, of Cr (16–18% by weight).

This means that the present invention permits specifically the manufacture of stainless steel fibers made from alloys which contain Ni and at least 16% Cr by weight whereby the average Cr/Cr+Fe+Ni ratio in the surface layers of these fibers ranges between 1% and 15% and wherein the Cr, Ni and Fe contents are expressed in at %. Preferably, this ratio should be less than 10%. Moreover the average value of the Cr/Ni ratio in the surface layer should be less than 80%.

The above mentioned average ratio for Cr/Cr+Fe+Ni of less than 10% as well as said accompanying average ratio for Cr/Ni of less than 80% is also achievable when the fibers retain more than 0.2% at of matrix material in their surface layer.

In analogy the chromium at the surface of FeCrAl-fibers will be depleted (will decrease) more according to the process of the invention than when stripping the bundle in $HNO_3$. This means that the FeCrAl-fibers according to the invention have a lower average Cr-content at their surface than conventional FeCrAl-fibers. Similarly in relatively Ni-rich alloy fibers as Hastelloy ®- and Inconel ®-fibers stripped according to the invention, the Nu-content at their surface will rise somewhat on the average compared to the same fibers stripped in $HNO_3$.

Figure 3:
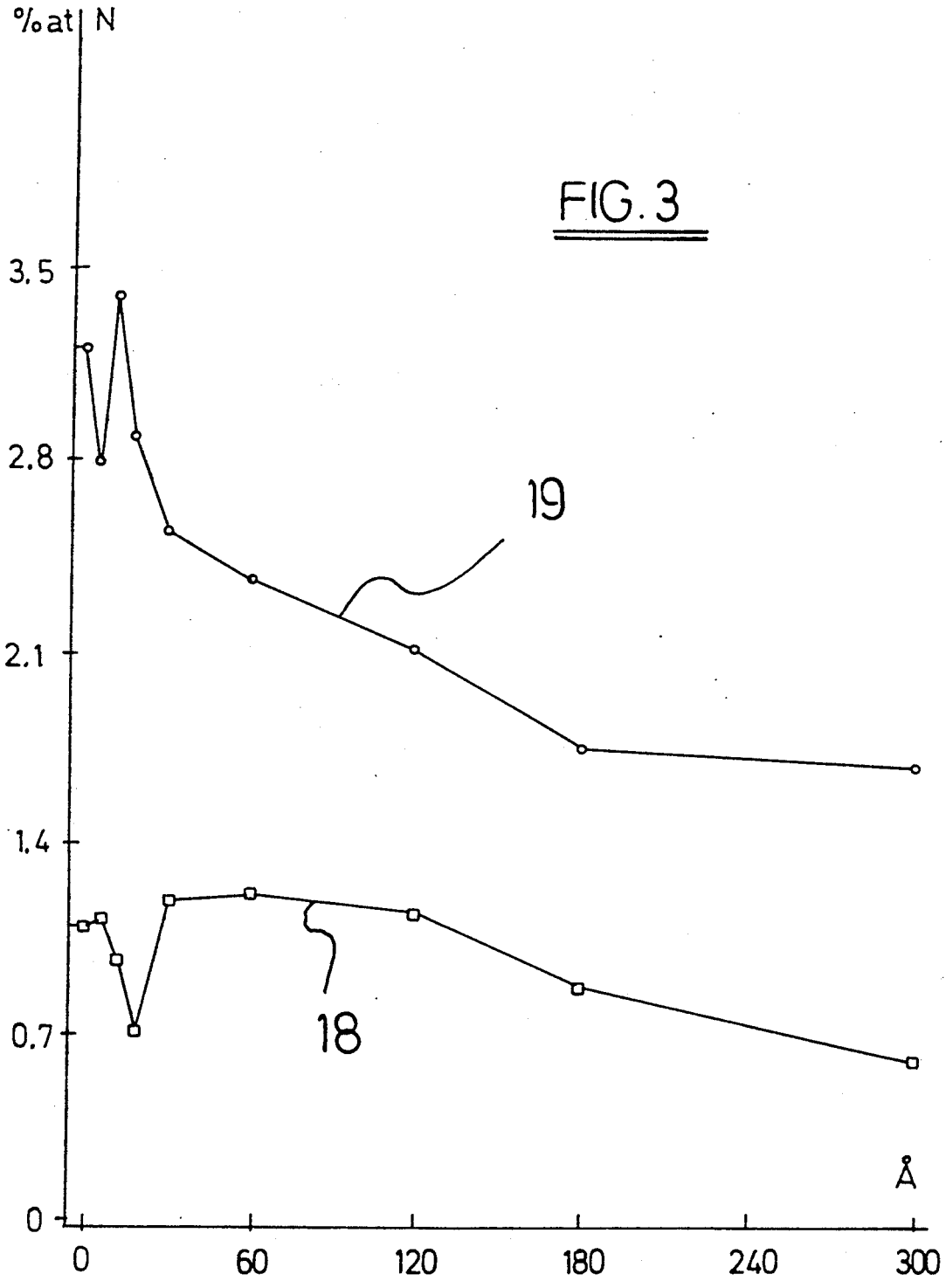
FIG. 3 illustrates the variation of the nitrogen content throughout the fiber thickness (close to the surface) of the same two types of fibers.

It is immediately apparent from the table that, unlike the fibers which were stripped by a standard method, the fiber which was treated in accordance with the invention, no longer shows any detectable quantities (0%) of copper at its surface. Furthermore, the nitrogen content in the surface layer of the fiber treated in accordance with the invention, is considerably lower than in case of the standard treatment. Curve 18 in FIG. 3 shows the variation of the nitrogen content in at % from the fiber surface (0 Å) to a depth of 300 Å for a fiber treated in accordance with the invention. Curve 19 represents the nitrogen variation for the fiber which was treated with $HNO_3$. It is remarkable that, as shown in FIG. 3, the relatively higher nitrogen content in case of standard treatment (curve 19) is also maintained a little further (deeper) below the fiber surface. This could suggest the higher aggressiveness of $HNO_3$ in comparison to the electrolytic stripping in an $H_2SO_4$ environment. After all, it was found that the value and variation of the sulfur content at the fiber surface as well as deeper into the fiber was comparable for both types of fibers. If it had been found that a fiber treated in accordance with the invention displayed higher sulphur contents than a fiber treated in the standard way (in $HNO_3$), we would have to decide on an aggressive attack by $H_2SO_4$ as well. However, the test results show that this is not the case. Apparently, we can conclude that the electrolytic process in accordance with the invention offers a gentler, less aggressive treatment for very thin fibers.

Therefore, it is a further characteristic of the bundled drawn metal fibers in accordance with the invention, that, on average, they display a lower nitrogen content in their surfaces than the fibers which have been stripped in $HNO_3$ in the standard way. Therefore, the metal fibers obtained by applying the invention, in particular the stainless steel fibers, will show, on average, a nitrogen content of at most 1.5 at % close to their surfaces.

Finally, both types of fibers were subjected to a corrosion test (Strauss test ASTM standard A 262-86 part E). The weight loss, after remaining 72 hours in a boiling copper sulfate solution, was 23% for the fiber treated in the standard way and only 15% for the fiber treated in accordance with the invention. Ergo, the fibers treated in accordance with the invention show a higher resistance to corrosion as well.

I claim:

1. Metal filaments obtained by bundled drawing of wires from a metal or an alloy, said wires having been embedded in a matrix of a metal which differs from the metal of said filaments, wherein the average concentration of matrix metal in a surface layer of the filaments is greater than 0% at. and at most 0.2% at.

2. Metal filaments according to claim 1 which are stainless steel filaments containing at least 10% Cr. by weight.

3. Stainless steel filaments according to claim 2 which further contain Ni, and wherein the Cr is present in an amount of at least 16% by weight.

4. Stainless steel filaments obtained by bundled drawing of stainless steel wires, comprising Ni and at least 16% Cr by weight, said wires having been embedded in a matrix of a metal which differs from said stainless steel, wherein the average Cr/Cr+Fe+Ni ratio in surface layers of the filaments is between 1% and 15%, wherein the Cr, Ni and Fe contents are expressed in at %.

5. Stainless steel filaments according to claim 4 wherein the average Cr/Cr+Fe+Ni ratio is less than 10%.

6. Stainless steel filaments according to claim 4 or 5 wherein the average Cr/Ni ratio in the surface layers is less than 80%.

7. Stainless steel filaments according to claim 4, wherein the average concentration of matrix metal in the surface layers is at most 0.2% at.

8. Stainless steel filaments according to claim 4, wherein the surfaces contain an average nitrogen content of at most 1.5% at.

9. Refractory metal filaments comprising Fe, Cr and Al, obtained by bundled drawing of the wires embedded in a matrix metal, and wherein the Cr content in surfaces of the filaments is lower than the Cr content in cores of the filaments.

10. Refractory metal filaments as in claim 9, wherein the average concentration of matrix metal in the filament surface is at most 0.2 at. %.

11. Refractory filaments as in claim 9, wherein the filament surfaces contain an average nitrogen content of at most 1.5 at. %.

12. Refactory metal filaments as in claim 9, wherein said filaments further comprise rare earths or Y.

* * * * *